US010533792B1

(12) United States Patent
Janeke

(10) Patent No.: US 10,533,792 B1
(45) Date of Patent: Jan. 14, 2020

(54) SYSTEMS AND METHODS FOR HELIUM LIQUEFACTION

(71) Applicant: Charles E. Janeke, Los Angeles, CA (US)

(72) Inventor: Charles E. Janeke, Los Angeles, CA (US)

( * ) Notice: Subject to any disclaimer, the term of this patent is extended or adjusted under 35 U.S.C. 154(b) by 0 days.

(21) Appl. No.: 16/134,777

(22) Filed: Sep. 18, 2018

Related U.S. Application Data

(63) Continuation-in-part of application No. 15/473,077, filed on Mar. 29, 2017.

(60) Provisional application No. 62/559,998, filed on Sep. 18, 2017, provisional application No. 62/581,570, filed on Nov. 3, 2017, provisional application No. 62/316,435, filed on Mar. 31, 2016.

(51) Int. Cl.
*F25J 1/00* (2006.01)
*F25B 9/04* (2006.01)

(52) U.S. Cl.
CPC ..... *F25J 1/0007* (2013.01); *F25B 9/04* (2013.01)

(58) Field of Classification Search
CPC ..... F25J 1/0007; F25B 9/04
See application file for complete search history.

(56) References Cited

U.S. PATENT DOCUMENTS

| | | | | |
|---|---|---|---|---|
| 5,591,947 | A * | 1/1997 | Andreou | B01D 59/34 204/157.22 |
| 6,332,593 | B1 * | 12/2001 | Kamiadakis | B64C 23/005 244/130 |
| 8,074,938 | B2 * | 12/2011 | Hyde | B64C 21/10 244/130 |
| 8,657,237 | B2 * | 2/2014 | Schulein | B64C 21/02 244/130 |
| 2005/0106017 | A1 * | 5/2005 | Segota | B63B 1/248 416/1 |
| 2015/0336656 | A1 * | 11/2015 | Rolfes | B64C 3/34 244/123.1 |

* cited by examiner

*Primary Examiner* — Ana M Vazquez
(74) *Attorney, Agent, or Firm* — J. Curtis Edmondson; Law Offices of J. Curtis Edmondson

(57) ABSTRACT

A helium liquefaction system with a thermally reactive nosecone is described. The system further includes a tip having a slanted intake aperture, a shaft, a thermally reactive bore and a nosecone functioning as a hypersonic vortex generator. Further the system may be configured as a stand-alone helium liquefaction plant, whereby the compressed helium is regeneratively chilled into the cryogenic zone.

13 Claims, 6 Drawing Sheets

SYSTEMS AND METHODS FOR HELIUM LIQUEFACTION

CROSS REFERENCES TO RELATED APPLICATIONS

Figure 1:
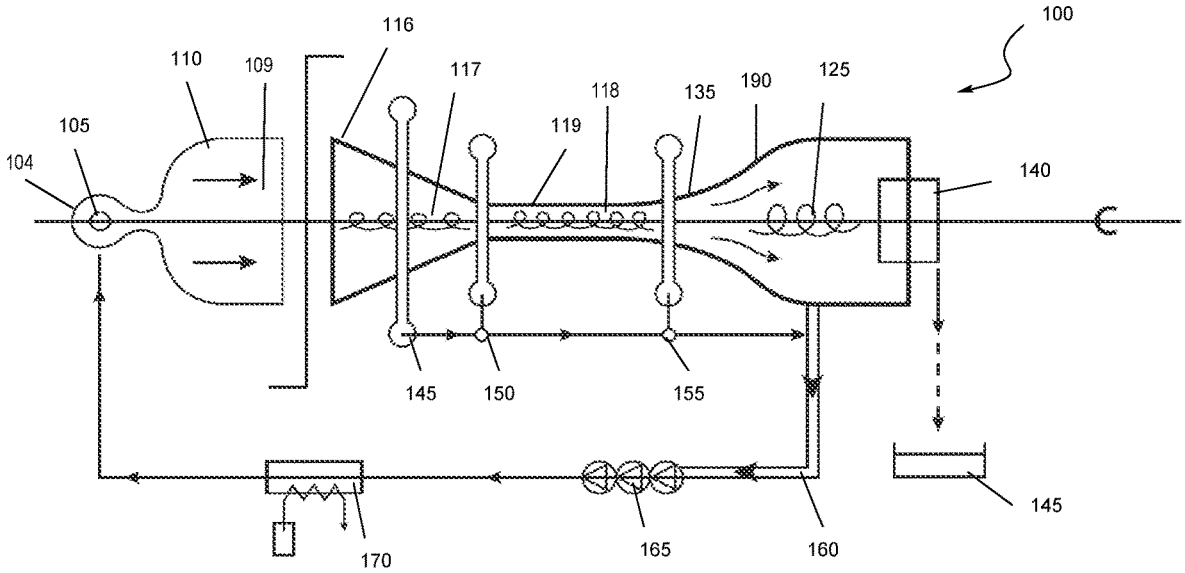

The present application claims the benefit of U.S. Provisional Patent Application No. 62/559,998 filed Sep. 18, 2017, which is incorporated herein by reference in its entirety. The present application claims the benefit of U.S. Provisional Patent Application No. 62/581,570 filed Nov. 3, 2017, which is incorporated herein by reference in its entirety. This present application is a CIP of Utility application Ser. No. 15/473,077 filed on Mar. 29, 2017, which claims benefit of Provisional Patent Application No. 62/316,435 filed on Mar. 31, 2016, which is incorporated herein by reference in its entirety.

FIELD

The inventive subject matter relates to the systems and methods for Liquid Helium generation.

BACKGROUND

Helium is the second most abundant element in the Universe, Helium however has a minimal presence of 5 ppm atmospheric on planet earth. However, Helium is also a byproduct of radioactive decay in the core of the earth that reappears as a natural gas component, whereby Helium is recovered via fractional distillation by liquefaction of the natural gas component and hence compressed for bulk transportation because of cryogenic chilling and bulk liquefaction complications.

The issue at stake is liquefaction of Helium. Although liquid Nitrogen and liquid Hydrogen may be applied to precool compressed Helium to 70K and 15K respectively, the 70/4K and 15/4K into the Helium saturation zone is extremely complex and costly to bridge because of (1) the perfect (IDEAL GAS) molecular (Helium) structure whereby enthalpy $h=U+pV$ reduces to $\Delta h=AU$ (internal energy)$=Cp\times\Delta t$ (a function of temperature) only and (2) 1st and 2nd Laws of thermodynamics whereby energy cannot be created or destroyed and heat can only flow from a warm to a cold source/sink respectively within the bounds of isentropic irreversibility.

The present state of art for liquefaction of Helium is limited to (1) Linde (1913) compression regression methodology and (2) Claude (1950) (turbo expansion) and work of via turbo expansion into the 4K Absolute-zero Helium distillation/liquefaction threshold. Because refrigeration becomes exponentially complex in the cryogenic zone, Carnot efficiency falls dramatically below 50K whereby the cost at 4K refrigeration equates to at least seventy-five times the cost at 300K refrigeration.

In order to overcome the constraints of (1) isentropic irreversibility generally (2) Carnot non-event and (3) Joule-Thomson dead-zone, a simple and highly efficient system and method for liquefaction of helium is desired.

SUMMARY

In an embodiment, a helium distillation super duct with a thermally reactive nosecone is described including a tip, the tip having a slanted intake aperture; a shaft; a thermally reactive bore and the nosecone functioning as a hypersonic vortex generator is described.

In another embodiment, a super duct may be configured as a standalone helium distillation/liquefaction plant whereby the compressed helium is regeneratively chilled into the cryogenic zone.

In a third embodiment the standalone super duct may be configured as a portable helium distillation/liquefaction.

In a fourth embodiment the super duct may be equipped with an extensive vacuum feature so as to drive the secondary harmonic vortex flux into the absolute zero threshold range.

In a fifth embodiment the super duct may be configured as a Carnot commercial chiller employing commercial refrigerants in lieu of Helium.

In a sixth embodiment the super duct may be configured as a commercial chiller employing commercial refrigerants optimized for high temperature climatic areas.

DRAWING DESCRIPTIONS

FIG. 1: Schematic representation of a system according to an embodiment.

Figure 2:
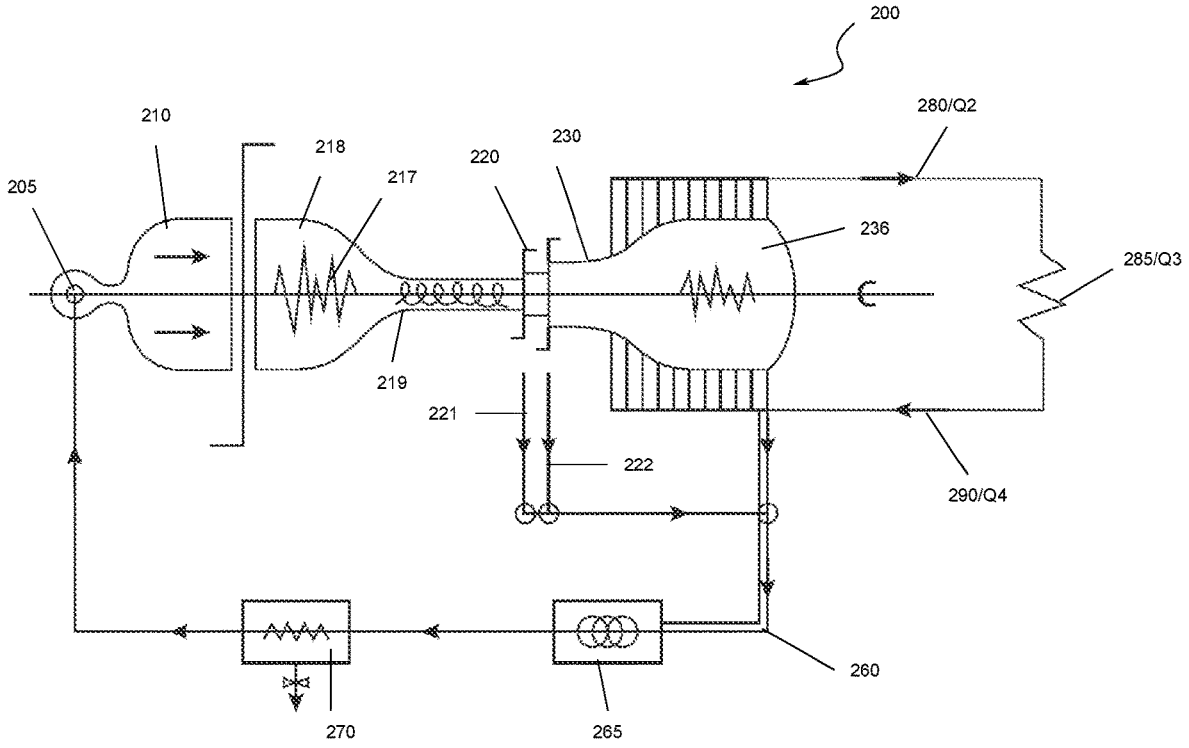

FIG. 2: Schematic representation of a system according to another embodiment.

Figure 3:
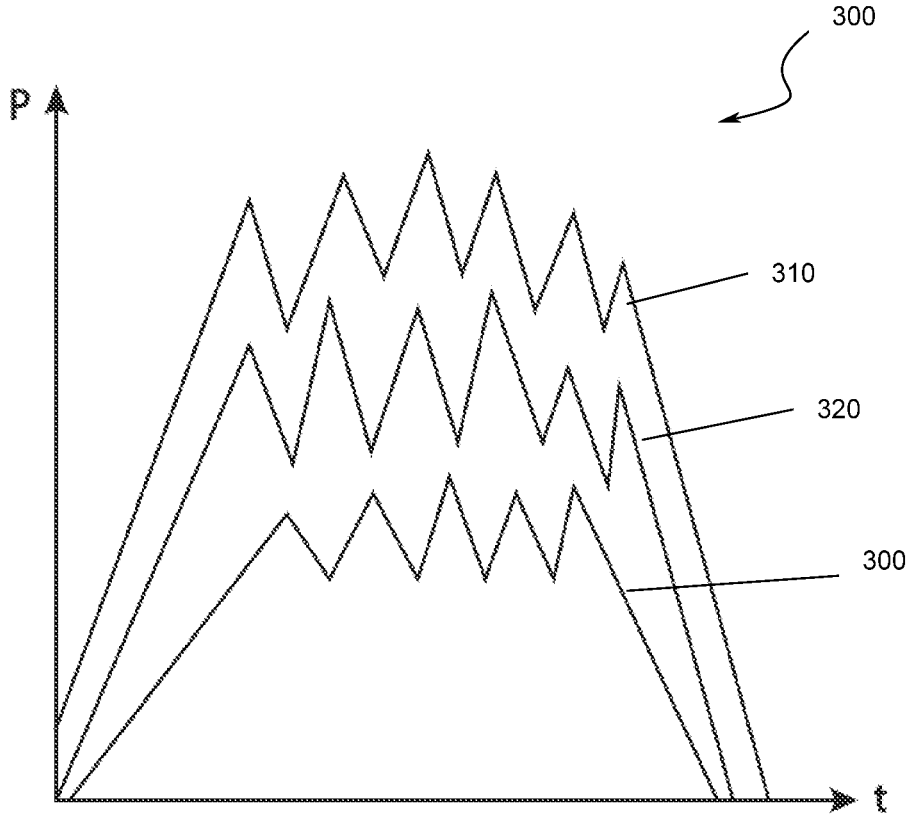

FIG. 3: Plot of temperature versus pressure.

Figure 4A:
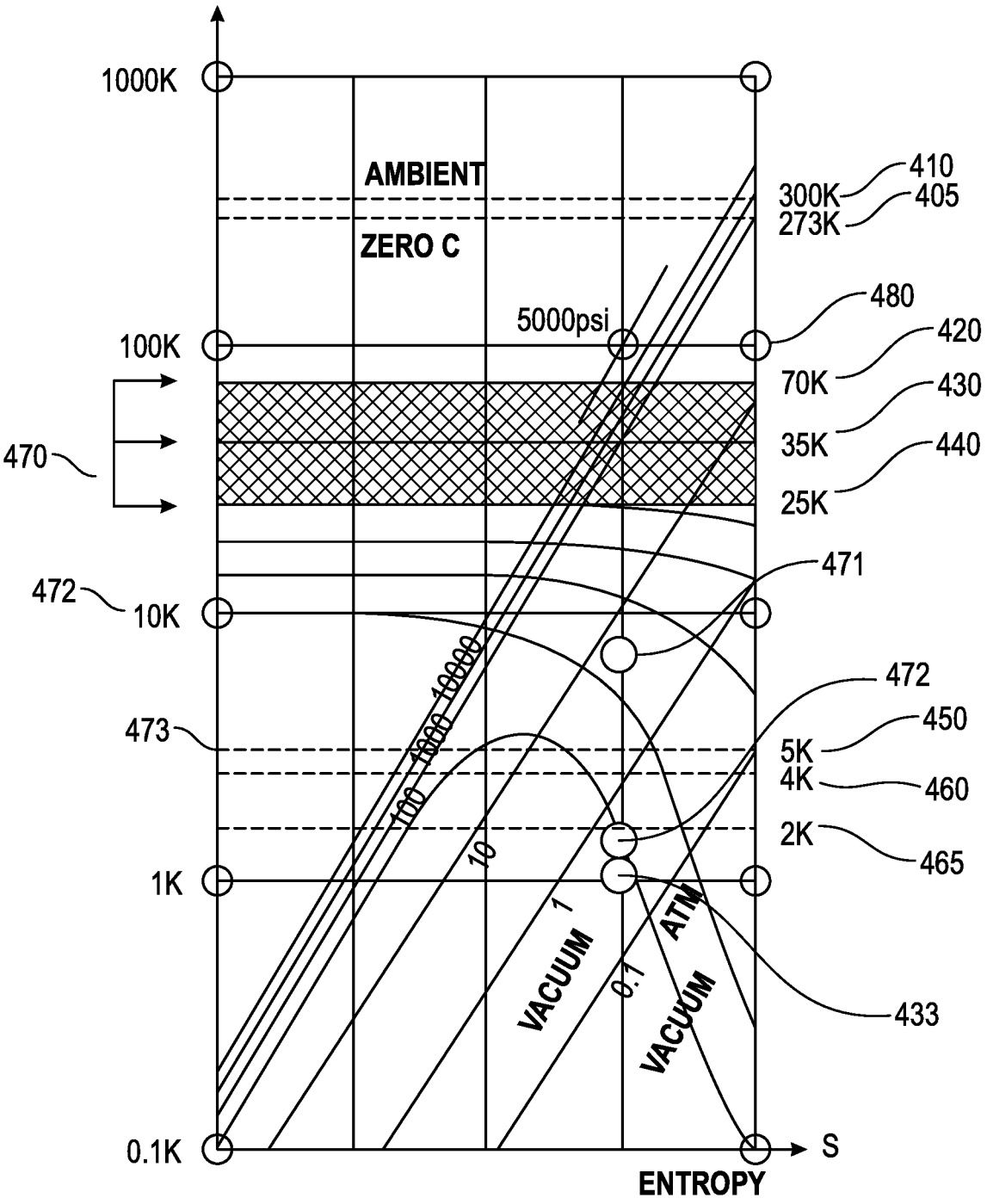
Figure 4B:
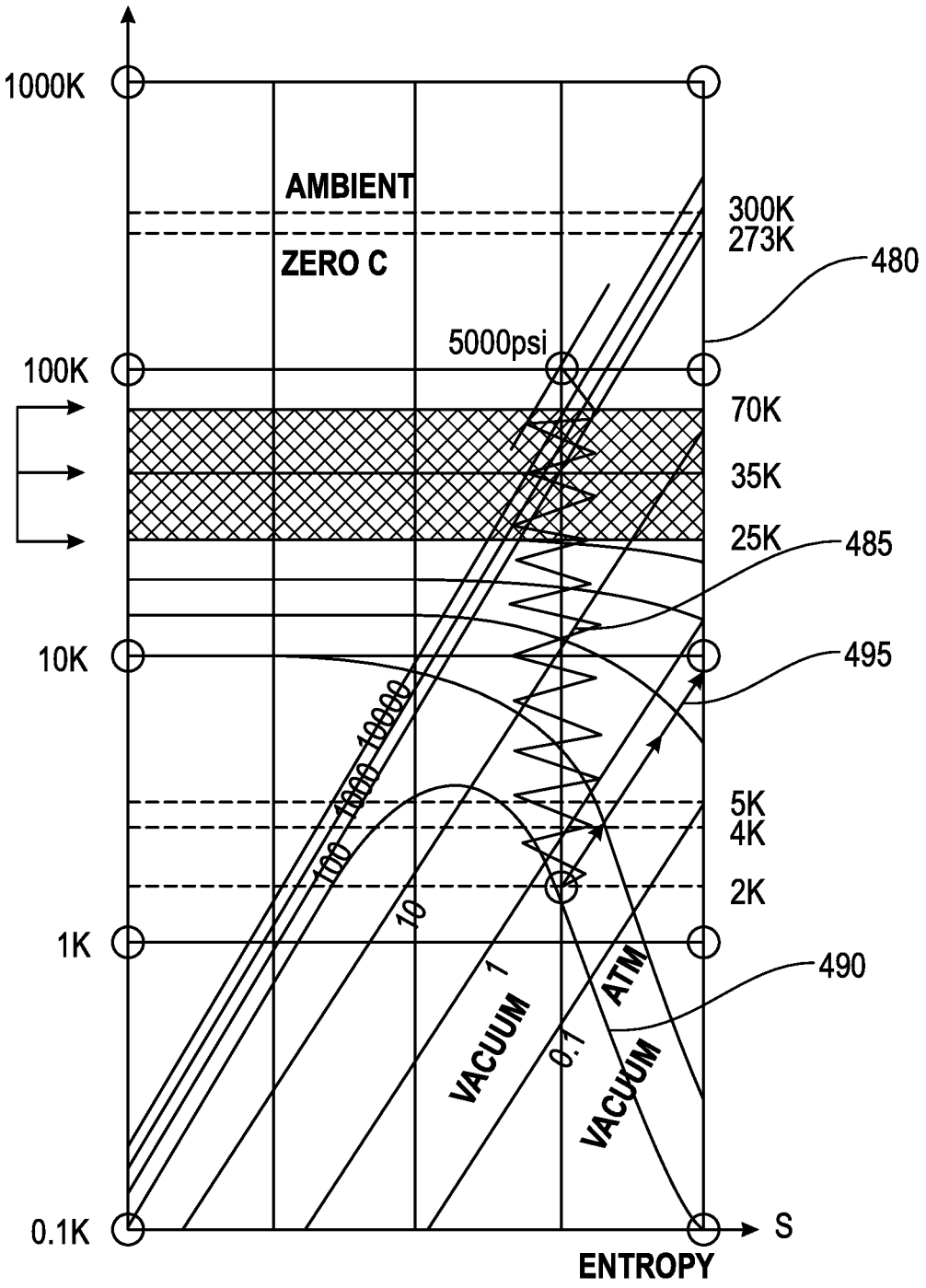
Figure 4C:
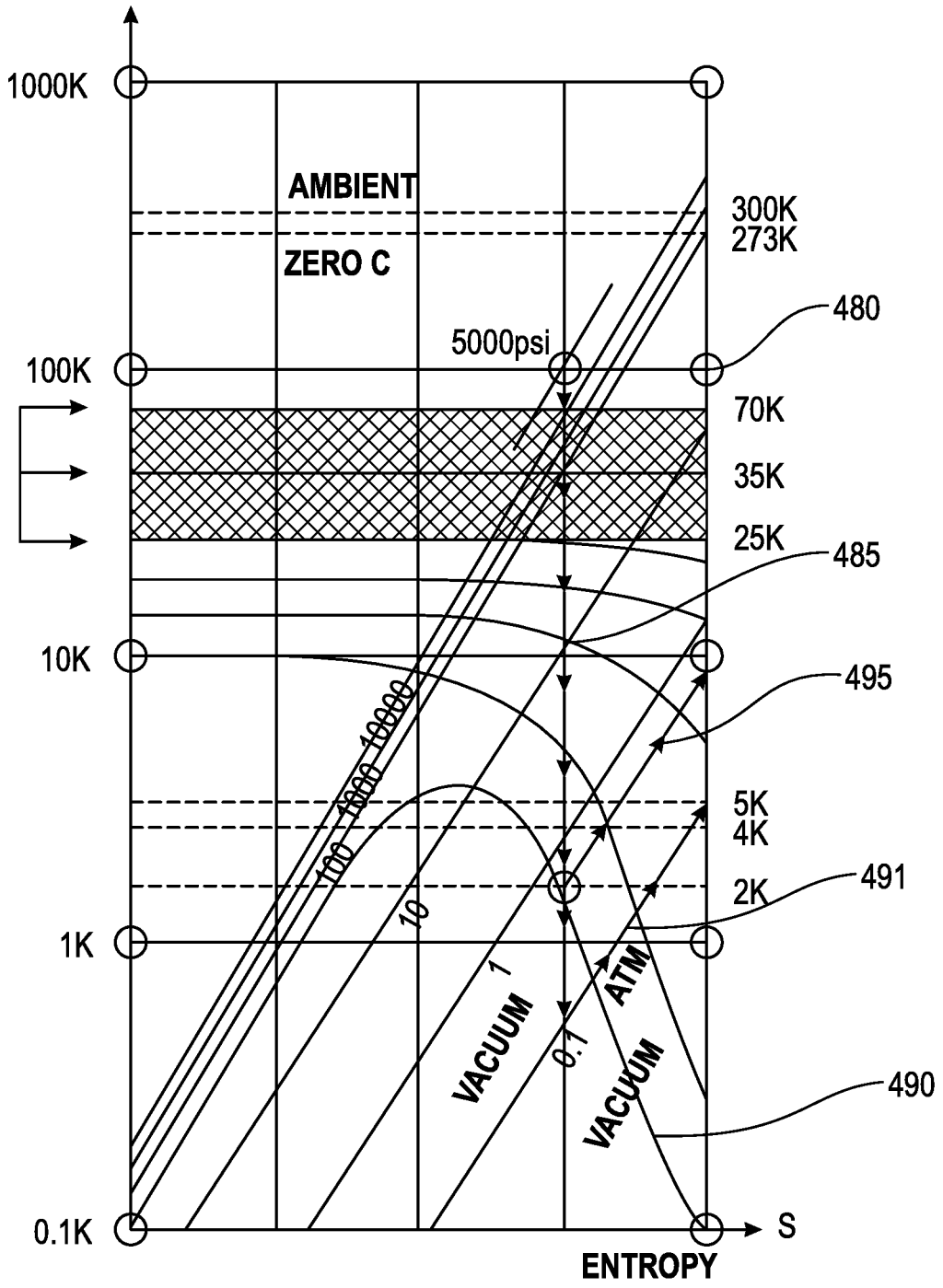

FIG. 4A-C: Plot of entropy versus temperature.

DETAILED DESCRIPTION

Persons skilled in the art will recognize that many modifications and variations are possible in the details, materials, and arrangements of the parts and actions which have been described and illustrated in order to explain the nature of this inventive concept and that such modifications and variations do not depart from the spirit and scope of the teachings and claims contained therein.

Referring FIG. 1, FIG. 1 represents a super duct system 100 for liquefaction of helium. A high-pressure helium source 105 at a tip 104 maintained at a pressure range of 1K-5 Kpsi is precooled with liquid Nitrogen and/or liquid Hydrogen so as to achieve a 35K cryogenic temperature range or cryogenic zone 109 in an isentropic nozzle 110. The helium is subsequently supersonically expanded into the thermally reactive nosecone 116 thereby generating harmonic pressure gyrations 117 that reaches into the 25K Joule-Thomson throttling zone through a duct structure 119 with a thermally reactive bore 118. At an expansion nozzle 135 with a secondary expansion bell 190 functions as a complex absolute zero Carnot refrigeration engine for Joule-Thomson throttling proximal to zero vacuum/suction. The harmonic pressure gyrations 117 upon reaching the expansion nozzle 135 get transformed to an expansion flux 125 reaching deep into the helium saturation zone, generating liquid helium that is captured in funnel receiver 140 and drained into a cryogenic container 145. In compliance with the second law of thermodynamics the work/heat of isothermal compression emanating on the path from primary helium source 116 to the expansion nozzle 135 is removed via thermally reactive spline cap disc slots or radial disc slots 145/150/155 via vacuum or suction conduit 160 prior to being compressed via high pressure compressor/pump 165 into precooler 170.

Referring FIG. 2, FIG. 2 represents a commercial refrigerant chiller system 200. In an exemplary embodiment a high pressure superheated freon refrigerant 205 is supersonically expanded in isentropic nozzle 210 and isothermally compressed in slanted vortex tube 218 generating gyrating harmonic vortex flux 217 subsequent to being transferred through a resonance shaft 219 and Coanda expansion switch 220 transforming into regenerative complex expansion nozzle 230 ensuing harmonic Carnot refrigeration engine 236 whereby work/heat of isothermal compression is being dissipated by means of Joule-Thomson throttling via bleed-discs 221/222 in conformance with second law of thermodynamics and compressor suction conduit 260 with compressor/pump 265 and precooler/condenser 170, spawning heat of refrigeration Q3 subsequently that is dissipated via chilled water circuit 280-Q2/285-Q3/290-Q4 servicing process heat load according to Q3=Q4−Q2.

Referring FIG. 3, FIG. 3 illustrates an actual regenerative ambient air stagnation pressure recording 300 at M5. An incident nosecone stagnation pressure 710/720 and shaft stagnation pressure 730 varies with temperature.

Referring FIG. 4A, FIG. 4A represents a logarithmically scaled graphical representation of the helium saturation chart highlighting (1) the Joule-Thomson dead zone and (2) ensuing stochastic bridge 1070 whereby liquid Helium may be distilled via (regenerative) double-bubble vortex tube synthesis. FIG. 4A consequently illustrates the challenge bridging the 70 to 25K Joule-Thomson (dead zone) 470 as to chilling/refrigerating/liquefacting compressed helium at ambient conditions 410/405 @300/273K through the Joule-Thomson dead zone by means of LN2/LH2 chilling 420/430 respectively @70/35K to 25K (1040) whereby Joule-Thomson throttling becomes reactive (and kick-starts (complex) Carnot refrigeration 472 @5/4/2K (450/460/465). Hence FIG. 4A illustrates copper (alloy) superconductivity 480 @4K and the 2K 465 helium vacuum threshold in proximity to the Helium saturation zone/curve 475.

In accordance with logarithmic scaled diagram 431 reference 410 infer ambient conditions @300K, 420 infer liquid Nitrogen precool threshold @70K, 430 infer liquid Hydrogen precool threshold @35K, 440 infer the 10 C disparity (35K to 25K) between known and necessary Helium liquefaction means, 450 infer the Helium liquefaction threshold @5K, 460 infers (copper) superconductivity threshold @4K, 470 infer Nitrogen disparity/dead zone/bridge (70K to 25K), 471 infer the Joule-Thomson throttling zone, 472 infer Carnot refrigeration reactive range, 473 infer the vacuum range whereby Joule-Thomson throttling trumps Carnot refrigeration, 431 depict $\Delta h=\Delta t$) Joule-Thomson responsiveness above 25K, 402 depict entry into Joule-Thomson reactive zone ($\Delta h=\Delta t+P\Delta V$)@25K, 433 depict rapidly expanding Joule-Thomson throttling @5K (driving complex/cryogenic Carnot cycle in compliance with the $2^{nd}$ Law of thermodynamics whereby heat can only be rejected from a warmer to a colder sink.

Referring FIG. 4B replicates FIG. 4A with the distinction of additional references 480/485/490/495 as to (1) 100K entry (2) stochastic/harmonic (stagnation pressure) gyrations (3) 2K Helium saturation curve/zone intersection and (4) vacuum suction resource respectively.

Referring FIG. 4C replicates both FIGS. 4A/B with the distinction of sub 1K (complex) Carnot vacuum range 491.

In order to transform a high pressure supersonic isentropic expansion nozzle into a regenerative supersonic stochastic vortex flux bridging the absolute-zero (Joule-Thompson) dead zone (and the constraints of Claude/Linde Helium liquefaction means), into a absolute-zero (cryogenic) refrigeration engine via (1) the addition of a secondary isentropic expansion nozzle that kickstarts Carnot refrigeration in the Helium saturation zone (2) fluctuating stagnation swings/surging and (3) fractional Helium bleed driving Joule-Thomson throttling/refrigeration (heat sink dissipating the work/heat of isothermal compression) in the (Helium) vacuum (suction) zone in compliance with the second law of thermodynamics whereby heat can only flow from a warm source to a colder sink.

TABLE 1

| 3.14286 Int | Rndm | ln | ^2 | ^3 | ^4 | ^0.286 | 1 − ^0.286 | ^0.286 − 1 |
|---|---|---|---|---|---|---|---|---|
| 1 | 1 | 0 | 1 | 0.94 | 1 | 1 | 0 | 0 |
| 2 | 4 | 1.39 | 16 | 0.95 | 256 | 1.49 | −0.12 | 0.49 |
| 3 | 2 | 0.69 | 4 | 0.94 | 16 | 1.22 | −0.058 | 0.22 |
| 4 | 8 | 2.08 | 64 | 0.97 | 4096 | 1.81 | −0.185 | 0.81 |
| 5 | 5 | 1.61 | 25 | 0.95 | 625 | 1.58 | −0.141 | 0.58 |
| 6 | 7 | 1.95 | 49 | 0.96 | 2401 | 1.74 | −0.173 | 0.74 |
| 7 | 1 | 0 | 1 | 0.94 | 1 | 1 | 0 | 0 |
| 8 | 4 | 1.39 | 16 | 0.95 | 256 | 1.49 | −0.12 | 0.49 |
| 9 | 2 | 0.69 | 4 | 0.94 | 16 | 1.22 | −0.058 | 0.22 |
| 10 | 9 | 2.2 | 81 | 0.97 | 6561 | 1.87 | −0.197 | 0.87 |
| 10 | 43 | 11.99 | 261 | 9.53 | 3418801 | 2.93 | −0.36 | 4.43 |
| | 4.3 | 0.28 | 6.07 | 19.04 | 79507 | 0.07 | −0.008 | 0.1 |

The experimental evidence for the above described helium liquefaction was found in the probability density postulation as shown by Table-1 above. The M3/4/5/7 actual reaction vector/measurements conformed with 0.28 of the theoretical (linear/isentropic) computational model. Applying the probability density postulation hence to a perfect harmonic Gauss-Markov compliant Super duct the absolute temperature transformation of 2.93 is being rendered. (which because of extreme/wildly stagnation gyrations generating 2.93× absolute temperature scale gyrations in the helium saturation zone in accordance with the Gauss-Markov driven randomness postulation) opens the door to absolute-zero Carnot refrigeration.

The invention claimed is:

1. An apparatus for a helium liquefaction comprising:
a tip, the tip having a slanted intake aperture;
a shaft;
a thermally reactive bore;
a regenerative isentropic expansion nozzle; and
a nosecone functioning as a vortex generator.

2. The apparatus for a helium liquefaction as in claim 1, further comprising thermally reactive spline capillary discs bleeding work/heat of isothermal compression.

3. The apparatus for a helium liquefaction as in claim 2, wherein the work/heat of isothermal compression is dissipated via Joule-Thomson throttling/refrigeration.

4. The apparatus for a helium liquefaction as in claim 2, wherein the spline capillary discs enable Joule-Thomson throttling within a Joule-Thomson zone @25K.

5. The apparatus for a helium liquefaction as in claim 1, wherein Helium is a working fluid.

6. The apparatus for a helium liquefaction as in claim 1, wherein Joule-Thomson throttling kickstarts Carnot refrigeration within a Helium saturation zone in compliance with a hot-to-cold flow of heat distinction in accordance with the second law of thermodynamics.

7. The apparatus for a helium liquefaction as in claim 1, wherein liquid Helium is being distilled by vacuum suction.

8. The apparatus for a helium liquefaction as in claim 1, wherein Joule-Thomson throttling/refrigeration and Carnot refrigeration are germane events within a helium saturation zone.

9. The apparatus for a helium liquefaction as in claim 1, wherein a primary stochastic vortex flux is transformed into a double helix vortex by means of a sudden Coanda expansion at a tail end of a vortex tube spawning Joule Thomson throttling refrigeration.

10. The apparatus for a helium liquefaction as in claim 9, wherein an exit double helix vortex flux is reset into a supersonic isentropic continuum downstream of a Coanda expansion switch by means of spline slots and a vortex flux spawning a tier Joule-Thomson refrigeration.

11. The apparatus for a helium liquefaction as in claim 10, wherein a high-pressure Helium source is sub-cooled into the cryogenic zone via a flashing of liquid nitrogen proximal 70K prior to hypersonic isentropic expansion and stochastic conversion.

12. The apparatus for a helium liquefaction as in claim 11, wherein the high-pressure Helium source is regeneratively chilled to proximal 35K by liquid hydrogen prior to hypersonic expansion enabling complex Carnot refrigeration.

13. The apparatus for a helium liquefaction as in claim 1, wherein the shaft is constructed out of inert and/or thermally reactive porous sinter.

* * * * *